US006066365A

United States Patent [19]

Jaekel et al.

[11] Patent Number: 6,066,365

[45] Date of Patent: May 23, 2000

[54] PROCESS FOR THE PREPARATION OF LOW-DUST GRANULES

[75] Inventors: Frank Jaekel, Bad Soden/Taunus; Gerd Reinhardt, Kelkheim/Taunus; Gerhard Nöltner, Frankfurt am Main, all of Germany

[73] Assignee: Hoechst Aktiengesellschaft, Germany

[21] Appl. No.: 08/063,985

[22] Filed: May 19, 1993

[30] Foreign Application Priority Data

May 19, 1992 [DE] Germany ..... 42 16 517

[51] Int. Cl.[7] ..... B05D 7/00

[52] U.S. Cl. ..... 427/212; 427/213; 256/186.25; 256/186.26

[58] Field of Search ..... 427/212, 213; 252/186.25, 186.26

[56] References Cited

U.S. PATENT DOCUMENTS

| | | | |
|---|---|---|---|
| 4,091,544 | 5/1978 | Hutchins | 34/9 |
| 4,126,573 | 11/1978 | Johnston | 252/99 |
| 4,497,757 | 2/1985 | Beimesch et al. | 264/13 |
| 4,867,895 | 9/1989 | Choy | 252/91 |

FOREIGN PATENT DOCUMENTS

| | | |
|---|---|---|
| 0 340 847 | 8/1989 | European Pat. Off. . |
| 0 376 360 | 4/1990 | European Pat. Off. . |

*Primary Examiner*—Shrive Beck
*Assistant Examiner*—Paul D. Strain
*Attorney, Agent, or Firm*—Connolly Bove Lodge & Hutz

[57] ABSTRACT

The present invention relates to a process for the preparation of low-dust granules, which comprises applying an aqueous solution or suspension of a hydrate-forming compound to a particulate starting material, the particulate starting material being at a temperature below the transition temperature of the hydrate-forming compound during the application of the aqueous solution or suspension and the aqueous solution being at a temperature above the transition temperature, effecting granulation subsequently or simultaneously and, if desired, drying the granules obtained.

14 Claims, No Drawings

PROCESS FOR THE PREPARATION OF LOW-DUST GRANULES

Bulk materials which have been granulated and are there-fore free-flowing are increasingly being used in many areas of production, for example in the detergent industry, and are replacing the pulverulent, poorly flowing products.

Particularly with regard to the handling of substances hazardous to health and the increasing requirements for a low level of exposure to harmful substances at the workplace, it is desirable to have granules with a minimal dust forming tendency.

EP-A-376 360 discloses a process for the preparation of solid, free-flowing granules which have bleaching activity and contain at least one water-insoluble peroxy acid and one hydrate-forming inorganic material, the granules prepared being said to have a minimal dust forming tendency ("dust-free"). The preparation of granules having bleaching activity is said to be effected by mixing the solid peracid, such as diperoxydodecanoic acid (DPDA), with the anhydrous, hydrate-forming inorganic material, such as sodium sulfate, the water content of the mixture having to be below the maximum content of the water of hydration of the hydrate-forming inorganic material and the temperature during the mixing process having to be lower than the hydration temperature of the hydrate-forming inorganic material.

It is the object of the present invention to provide an economical and energy-saving process for the preparation of low-dust granules, in particular those which contain heat-sensitive substances.

The invention relates to a process for the preparation of low-dust granules, which comprises applying an aqueous solution or suspension of a hydrate-forming compound to a particulate starting material, the particulate starting material being at a temperature below the transition temperature of the hydrate-forming compound during the application of the aqueous solution or suspension and the aqueous solution or suspension being at a temperature above the transition temperature, effecting granulation subsequently or simultaneously and, if desired, drying the granules obtained.

Granule components which are suitable for the preparation of granules, or the granules themselves, are used as particulate starting materials for the process according to the invention. The terms granule components and granules are to be understood broadly. It has been found that the process according to the invention is not restricted to certain granule components or granules, but rather all granule components and granules to which an aqueous solution of a hydrate-forming compound can be applied may be used as particulate starting materials. Granules or granule components such as those known in the detergent, paint or pharmaceutical industries are preferred.

The process according to the invention will now be described as applied to the particularly preferred granules and granule components.

The preferred granules components include the components as usually used for the preparation of granules having bleaching activity. The following may be mentioned here in particular:

active substances
granulating auxiliaries
film-forming coating substances
additional components.

The following may be used as active substances:

heat-sensitive substances
bleaches and bleach activators.

Examples of heat-sensitive substances are enzymes, such as lipases and amylases. Suitable bleaches and bleach activators are mentioned in EP-A-376 360.

Preferred bleaches are:

a) diperoxycarboxylic acids, such as 1,12-dodecanediperoxycarboxylic acid and 1,9-nonanediperoxycarboxylic acid,
b) peroxycarboxylic acids having an amide bond in the hydrocarbon chain, such as N-decanoyl-6-aminoperoxycaproic acid, 5-(N-nonylcarbamoyl)-peroxyvaleric acid and 3-(N-nonylcarbamoyl)-peroxypropionic acid,
c) sulfonylperoxycarboxylic acids, such as 4,4'-sulfonyldiperoxypropionic acid, 3,3'-sulfonyldiperoxybenzoic acid, 4-methylsulfonylperoxybenzoic acid and 3-decylsulfonylperoxypropionic acid,
d) unsubstituted or mono- or polysubstituted phthalimidoperoxycarboxylic acids of the formula

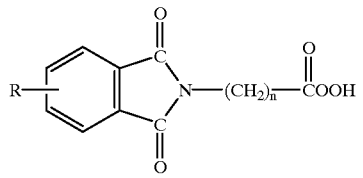

where hydrogen, chlorine, bromine, $C_l$–$C_{20}$-alkyl, $C_1$–$C_{20}$-alkenyl, aryl, preferably phenyl or alkaryl, preferably $C_1$–$C_4$-alkylphenyl, and n is 1 to 20, such as ε-phthalimidoperoxycaproic acid or ω-phthalimidoperoxylauric acid and ω-phthalimidoperoxydecanoic acid.

Since pure peracid compounds are difficult to handle, it is advisable to use them in the form of agglomerates. Suitable agglomerates are mentioned in EP-A-376 360, agglomerates comprising a peracid and an organic, water-insoluble compound, such as lauric acid, being preferred.

Suitable bleach activators are preferably tetraacetylethylenediamine (TAED), tetraacetylmethylenediamine, tetraacetylglycolunil (TAGU), diacetyldioxohexahydrotriazine (DADHT), pentaacetylglucose (PAG), sodium acetoxybenzenesulfonate, sodium nonanoyloxybenzensulfonate (NOBS) and sodium benzoyloxybenzenesulfonate (BOBS).

The granulating auxiliaries used can be divided into two groups:

a) inorganic sulfates and/or phosphates
b) organic compounds having surfactant properties (surfactants).

a) Suitable inorganic sulfates/phosphates are sulfates/phosphates of alkali metals or alkaline earth metals which are readily water-soluble and are neutral or acidic after dissolution. Sodium sulfate, sodium bisulfate, potassium sulfate, potassium bisulfate, sodium dihydrogen sulfate or magnesium sulfate are preferably used. Mixtures of the salts can also be used.

b) Water-soluble, anionic sulfates or sulfonates or zwitterionic surfactants are preferably used as surfactant substances. Examples of such compounds are alkali metal or alkaline earth metal salts of alkylsulfates or alkylsulfonates having an alkyl group of 9 to 22 carbon atoms, which are obtained from natural or synthetic fatty alcohols or from hydrocarbons, for example, paraffin. Further suitable surfactants which may be used are salts of alkylbenzenesulfonates in which the alkyl group contains 9 to 22 carbon atoms and may be branched or straight-chain. All the compounds mentioned can if required carry ethoxylated groups in the molecule. Preferred compounds are secondary alkanesulfonates (Hostapur® SAS), alkylsulfates and alkylbenzenesulfonates. The substances may be used in solid or pasty form or as a solution for the granulation. In this case, preferred solvent is water. Mixtures of the granulating auxiliaries of group a) may be used for the granulation in any ratio with those of group b). The amount of the granulation auxiliary in the prepared granules is 5 to 60, preferably 20 to 50, % by weight, particularly preferably 30 to 45% by weight.

Polymers of (meth)acrylic acid or copolymers of these acids with other unsaturated organic carboxylic acids are used as film-forming coating substance. These compounds may also be used in partly neutralized form. Possible polymers are, for example, polyacrylic acid, polymethacrylic acid and copolymers of acrylic acid and methacrylic acid with maleic acid, fumaric acid, or itaconic acid. These compounds have an average molecular weight of 800–2,000,000, preferably 2,000–500,000. The polymeric film formers are preferably applied in aqueous solution to the particulate starting materials. Their concentration in the solution is 5 to 50% by weight, preferably 10 to 30% by weight. The amount of the film-forming substance in the granules is 1 to 15, preferably 3 to 12, % by weight.

In some cases, it may be desirable for the granules to contain certain additional components. Examples of these are chelate-forming systems, dyes and agents for regulating the pH. It is known that metals are capable of catylically decomposing organic or inorganic per compounds. In order to overcome this problem, up to 3% by weight of the chelate former may be added to the granules. Preferred compounds are inorganic or organic phosphates or phosphonates or aminomethylenecarboxylic acids. Examples of these are ethylenediaminetetramethylene-phosphonic or -carboxylic acids or diethylenetriamine-pentamethylenephosphonic acid or salts thereof. Agents for adjusting the pH are used for changing or maintaining the pH within the granules. Examples of these are citric acid, fatty acid or succinic acid or salts, such as silicates, phosphates or sodium bisulfate.

It is also possible to use granules as starting materials and to further process these granules with the aid of the process according to the invention to give low-dust granules. The prepared granules used generally have the typical granule structure as described above.

Hydrate-forming compounds are in principle all compounds with a transition temperature. The transition temperature is to be understood as meaning the temperature at which the hydrate-forming compound releases or takes up the bound water of crystallization. If the hydrate-forming compound used is sodium sulfate, the transition temperature is 32.5° C. Below this transition temperature, the sodium sulfate forms a decahydrate with the water of crystallization. Above this temperature, the major part of the water of crystallization is set free again. Sodium acetate, sodium carbonate, zinc nitrate, sodium sulfate, magnesium sulfate, magnesium nitrate, lithium bromide, sodium phosphate, sodium hydrogen phosphate or mixtures thereof are preferred.

Suitable apparatuses for the preparation of the dust-free granules are, for example, mixers, extruders or pelletizers. Suitable mixers are those which can be operated batchwise or continuously and permit mixing under high shear forces. Examples of such batch mixers are "Dry Dispenser"® (Baker, Perkins, Peterborough, UK)

"Diosna-Pharmamix"® (Diercks, Osnabrück, Germany)

"Matrix"® (Fielder Ltd., Eastlake, UK)

"Baumeister"® (Ruberg, Paderborn, Germany)

"Ruberg Hochleistungsmischer"® (Ruberg, Paderborn, Germany)

"MTI, Typ EM"® (MTL, Detmold, Germany) and

"Eirich Mixers"® (Eirich Hardheim, Germany)

"Lödige Pflugscharmischer"® (Lödige Maschinenfabrik, Paderborn)

"Lödige Recycler CB"® (Lödige Maschinenfabrik, Paderborn)

The "Konax Durchlaufmischer"® (Ruberg, Paderborn, Germany) may be mentioned as an example of a continuously operated mixer. Examples of extruders are "Alma"® "Unica"®, "Xtruder"® and "Werner Pfleiderer"®. Examples of conventional pelletizers are the makes from Simon Heesen or the maromarizer from Russel Finings Ltd., London, UK. Further apparatus which can be used for the preparation of the dust-free granules by the process according to the invention are fluidized-bed mixers in which various temperature levels can be set.

The preparation of the low-dust granules is described below.

The particulate starting material is introduced into a suitable apparatus, preferably a fluidized-bed granulator.

If the particulate starting material consists of the individual granule components, the water-insoluble components, such as active substance, are advantageously introduced into the apparatus first, with or without some of the hydrate-forming compound, and the remaining water-soluble components are applied with the solution of the hydrate-forming compound.

In a preferred embodiment, the active substance, such as the peracid, and the hydrate-forming compound are charged into a fluidized-bed granulator in a weight ratio of from 3:1 to 8:1, preferably from 4:1 to 7:1. Ready-prepared granules are usually introduced into the apparatus without further additives and without pretreatment steps.

After the introduction, the temperature of the granules or granule components is adjusted so that it is below the transition temperature of the hydrate-forming compound used.

The temperature data below relate to the use of sodium sulfate as the hydrate-forming compound with a transition temperature of 32.5° C. The temperature ranges stated in connection with this specific transition temperature can be applied analogously when other hydrate-forming compounds are used.

When a fluidized-bed granulator is used, a moderate air stream with a temperature of 37° C., preferably 22 to 35° C., flows through the granule components or granules. The air temperature should be chosen so as to avoid a severe thermal stress on the content of the fluidized-bed granulator and may also be above 37° C. What is important is that the particulate starting materials are at a temperature below 32.5° C., preferably up to 20° C.

An aqueous, preferably saturated aqueous, sodium sulfate solution is applied to the granules or granule components, the temperature of the solution being above 32.5° C., preferably up to 40° C. The application is usually effected by spraying on but, depending on the apparatus, may also be carried out by dropwise addition, introduction in the form of a jet, addition via a distributor screen, addition via a distributor weir or other measures known to one skilled in the art. The aqueous solution may contain additional components, such as water-soluble surfactants and/or film-forming coating substances. The aqueous solution is preferably composed of 90–98% by weight of a hydrate-forming compound, for example anhydrous sodium sulfate, 2–10% by weight of a coating substance, such as polyacrylic acid, and 0–10% by weight of a surfactant, such as ®Hostapur SAS.

The concentration of the aqueous solution is usually 30–70% by weight, preferably 50–60% by weight. It has been found that it is advantageous to choose the concentration of the solution such that the weight ratio of particulate starting materials to solution is approximately equal. It is also possible to use supersaturated solutions in which the solids are present in finely dispersed form, or suspensions of sparingly soluble or insoluble solids.

The aqueous solution or suspension may also contain water-miscible, organic solvents, such as alcohols, ethers or esters, and these organic solvents must not react with the starting materials used.

While the solution is being sprayed on, the temperature of the particulate starting materials is below the transition temperature of the hydrate-forming compound, and the temperature of the solution is above the transition temperature, and it should be ensured that the temperature of the sprayed particulate starting materials is also always below the transition temperature. If individual granule components are used as starting materials, it is advisable to carry out the granulation during spraying. However, it is also possible to spray on some or all of the solution and then to effect granulation. It has been found that the granulation process also leads to improved properties of the granules used with regard to mechanical strength and hence to low-dust granules.

The amount of solution is preferably chosen such that these moist granules initially formed contain between 8 and 20% by weight of water.

The processes of spraying on and of granulation may be followed by suitable drying steps which, if required, may be carried out in the same apparatus but with the aid of other gentle methods. However, the additional drying is required only when a particularly low water content of the granules according to the invention is desired. In the case of the process according to the invention, it has been found that, as a result of the chosen temperature ratio between the particulate starting materials and the solution, some of the hydrate-forming compound crystallizes out after spraying, and a drying effect on the granules is achieved by means of the heat of crystallization evolved.

The low-dust granules prepared in this manner have a granule size distribution in the range from 0.1 to 5 mm, preferably 0.4 to 3 mm.

It is of course directly possible subsequently also to apply inert coats of various types, either in the form of cohesive film or in the form of deposited powders, to the granules prepared according to the invention, but a particular advantage in the present invention is that such a measure can be dispensed with.

A particularly preferred field of use of the granules is the bleaching of textiles in conjunction with a wash treatment. For this purpose, the granules can be used in pure form, i.e. without further additives, although they are preferably formulated as scatterable mixtures with other active substances which are required for textile treatment.

What is claimed is:

1. A process for the preparation of low-dust granules, which comprises applying an aqueous solution or suspension of a hydrate-forming compound to a particulate starting material, the particulate starting material being at a temperature below the transition temperature of the hydrate-forming compound during the application of the aqueous solution or suspension and the aqueous solution or suspension being at a temperature above the transition temperature, effecting granulation subsequently or simultaneously and, if desired, drying the granules obtained.

2. The process as claimed in claim 1, wherein the particulate starting materials used are granules or components thereof.

3. The process as claimed in claim 2, wherein granules having bleaching activity or components thereof are used.

4. The process as claimed in claim 1, wherein the hydrate-forming compound used is lithium bromide, sodium acetate, sodium carbonate, sodium phosphate, sodium hydrogen phosphate, magnesium sulfate, magnesium nitrate or zinc nitrate, or a mixture thereof.

5. The process as claimed in claim 1, wherein the aqueous solution or suspension contains water-soluble coating substances.

6. The process as claimed in claim 1, wherein the aqueous solution or suspension contains water-miscible, organic solvents.

7. The process as claimed in claim 1, wherein the aqueous solution or suspension has a concentration of 30–70% by weight.

8. The process as claimed in claim 1, wherein the application of the aqueous solution is effected by dropwise addition, introduction in the form of a jet, addition via a distributor screen, addition via a distributor weir or spraying on.

9. A process as claimed in claim 6, wherein the organic solvent is an alcohol, an ether, an ester or a mixture thereof.

10. A process as claimed in claim 7, wherein the aqueous solution or suspension has a concentration of 50–60% by weight.

11. A process as claimed in claim 8, wherein the application of the aqueous solution is effected by spraying on.

12. The process as claimed in claim 1, wherein the aqueous solution or suspension contains water-soluble coating substances and surfactants.

13. The process as claimed in claim 1, wherein the hydrate-forming compound used is sodium sulfate.

14. The process as claimed in claim 1, wherein the hydrate-forming compound is a mixture of lithium bromide, sodium acetate, sodium carbonate, sodium phosphate, sodium hydrogen phosphate, magnesium sulfate, magnesium nitrate, or zinc nitrate with sodium sulfate.

* * * * *